US006696651B1

(12) United States Patent
Koopmeiners et al.

(10) Patent No.: US 6,696,651 B1
(45) Date of Patent: Feb. 24, 2004

(54) LOCK OUT DEVICE FOR MINIATURE CIRCUIT BREAKER AND MANUAL MOTOR CONTROLLER

(75) Inventors: David Koopmeiners, Franksville, WI (US); Dennis Drake, Cudahy, WI (US); Dennis Schmidt, West Allis, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 33 days.

(21) Appl. No.: 10/261,277

(22) Filed: Sep. 30, 2002

(51) Int. Cl.[7] ..... H01H 9/28

(52) U.S. Cl. ..... 200/43.14; 200/43.15; 200/43.19

(58) Field of Search ..... 200/43.14, 43.15, 200/43.16, 43.11, 43.21, 43.19, 334, 333

(56) References Cited

U.S. PATENT DOCUMENTS 4,733,029 A * 3/1988 Kobayashi et al. ..... 200/43.15
5,147,991 A * 9/1992 Jordan, Sr. ..... 200/43.14
5,449,867 A * 9/1995 Kelaita et al. ..... 200/43.14
5,817,998 A * 10/1998 Siebels et al. ..... 200/43.14

* cited by examiner

*Primary Examiner*—Anh Mai
*Assistant Examiner*—M. Fishman

(57) ABSTRACT

A lockout for circuit breakers provides a channel holding the circuit breaker toggle bar with a set screw that may be accessed only when an eye of the lockout is free of a padlock shackle. The eye is oriented vertically so that the padlock may be rotated to not interfere with adjacent circuit breakers being locked out or operated.

20 Claims, 3 Drawing Sheets

LOCK OUT DEVICE FOR MINIATURE CIRCUIT BREAKER AND MANUAL MOTOR CONTROLLER

CROSS-REFERENCE TO RELATED APPLICATIONS

STATEMENT REGARDING FEDERALLY SPONSORED RESEARCH OR DEVELOPMENT

BACKGROUND OF THE INVENTION

The present invention relates to electrical circuit breakers including motor controllers and, in particular, to a lockout preventing unauthorized activation of a circuit breaker or motor controller.

Safety practice requires that electrically powered machines be isolated from power before adjustment, maintenance, or repair of the machine by a human operator. Such isolation must be done in a manner to prevent accidental reconnection.

This isolation may be accomplished by opening the circuit breaker associated with the machine and locking the circuit breaker toggle in the "off" position using a "sealed" wire connection or a padlock and a special locking fixture. As used herein, the term "circuit breaker" should be considered to include manual motor controllers and the like.

Referring to FIG. 1, a prior art single-pole, miniature-style circuit breaker 10, includes a front escutcheon plate 12 having an outer edge 14 and an opening 16 therein through which a toggle operator 18 extends. The toggle operator 18 pivots in a longitudinal direction 20 between a downward OFF position 22 (as shown in FIG. 1), and an upward ON position 24. A free end of the toggle operator 18 is attached to a transversely extending bar toggle 26 that may be easily operated by a person's finger.

Referring also to FIG. 2, a prior art lockout 30 for such a circuit breaker 10 uses an aluminum extrusion having a transversely extending channel 32 with opposed lower wall 34 and upper wall 36. The channel 32 is sized to receive the toggle bar 26 when it is in the OFF position. A set screw 38 passes through the upper wall 36 into the channel 32 so that the toggle bar 26 may be captured between a tooth 40 projecting inward from lower wall 34 and a pointed tip of the set screw 38.

The upper wall 36 attaches to a foot 42 which abuts the escutcheon plate 12 at a front upper edge 14 of escutcheon plate 12. In this way, motion of the toggle bar 26 in an upward arc along the longitudinal axis 20, such as would tip the lockout 30, is resisted by pressure of the foot 42 against the front surface of the escutcheon plate 12. As shown in the drawing, for some circuit breakers 10, the foot 42 of the lockout 30 is very close to the edge 14 of the escutcheon plate 12 and may slip over that edge 14 allowing activation of the circuit breaker 10 despite the lockout 30.

The head 46 of the set screw 38 extends into an opening of an eye 44 attached generally to the upper wall 36 and providing a cylindrical transverse aperture. An access hole 48 in the wall of the eye 44, opposite the head 46 of the set screw 38, allows insertion of a screwdriver blade 50 to engage the head 46 for tightening the set screw 38 against the toggle bar 26 or loosening it therefrom.

Referring also to FIG. 3, a shackle 52 of a padlock may be inserted through the eye 44 to block access by the screwdriver blade 50 to the head 46 of the set screw 38. Generally, the shackle 52 must be somewhat smaller than the diameter of the eye 44 because of the protrusion of the head 46 into the aperture of the eye 44. The transverse extending eye 44 requires that the shackle 52 be positioned so that the case 54 of the padlock lies across adjacent circuit breakers 10' and 10" interfering with operation of these circuit breakers 10' and 10" and preventing the use of a second lockout on these adjacent circuit breakers 10' and 10".

BRIEF SUMMARY OF THE INVENTION

The present invention provides a mechanical lockout also engaging a toggle bar of a circuit breaker but in which the eye is positioned to allow a padlock used with the lockout to hang edgewise. This change in the orientation of the padlock reduces or eliminates interference between the padlock and adjacent circuit breakers and/or lockouts on those circuit breakers. An improved foot on the lockout includes a heel engaging an aperture of the escutcheon plate of the circuit breaker preventing slippage of the lockout with movement of the toggle bar of the circuit breaker. The set screw of the lockout is further mounted in a counter bore below the surface of the eye allowing proportionally larger shackled locks and improved tamper resistance.

More specifically, the present invention provides a lockout for a circuit breaker having a toggle operator switchable between an ON and OFF position. The lockout includes a transverse channel having opposed first and second walls for receiving the toggle operator therebetween, the first wall including a hole extending therethrough. A screw fitting within the hole can be extended toward the second wall by rotation of the screw to clamp the toggle operator within the channel. A foot attached to the channel engages a portion of the circuit breaker, other than the toggle operator, to resist switching of the toggle operator when the toggle operator is clamped in the channel. A longitudinal eye is attached to the first wall to receive a padlock shackle along a direction substantially perpendicular to the channel so that the shackle blocks access to the head of the screw.

Thus, it is one object of the invention to provide an improved orientation of the eye of a lockout allowing adjacent circuit breakers to be operated or to be locked out without interference from the padlock.

The screw may be a set screw having its head positioned within a counter bore of the hole so that the received shackle covers the counter bore.

Thus it is another object of the invention to eliminate access to the head of the set screw and to allow the use of a larger diameter shackle associated with commonly available padlocks and/or to reduce the necessary size of the eye.

The hole may open into the longitudinal eye.

Thus, it is another object of the invention to prevent movement of the shackle within the eye from allowing access to the set screw.

The toggle of the circuit breaker may extend from an opening in an escutcheon plate and the foot may include a heel portion fitting within the opening.

Thus, it is another object of the invention to provide a more positive lockout that cannot be defeated by a sliding of the lockout mechanism along the surface of the escutcheon plate.

The foot may also include a toe fitting over the outer edge of the escutcheon plate.

Thus it is another object of the invention to provide a positive indication of a proper fitting of the lockout to the circuit breaker that may indicate that the lockout is not being used on the toggle when the toggle is in the OFF position as is desired.

The eye may be oriented so that the shackle of the padlock is substantially vertical when the circuit breaker is mounted so that the toggle operator is switched in a vertical direction.

Thus, it is another object of the invention to allow the padlocks to hang stably without gravitationally induced twisting and interference.

The channel may fully cover the toggle operator when the toggle operator is positioned within the channel.

Thus, it is another object of the invention to better enclose the toggle to reduce tampering and removal of the operator by twisting.

Alternatively, the channel may extend at least two times the length of the toggle operator to engage toggle operators of adjacent circuit breakers.

It is thus another object of the invention to provide the ability to lockout multiple adjacent circuit breakers.

These particular features, objects and advantages may apply to only some embodiments falling within the claims and thus do not define the scope of the invention.

DETAILED DESCRIPTION OF THE PREFERRED EMBODIMENT

Figure 1:
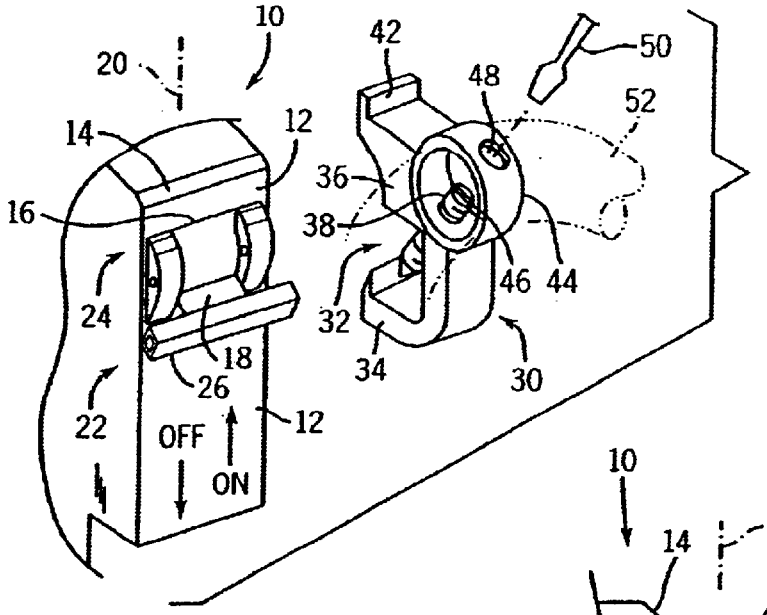
FIG. 1 PRIOR ART
FIG. 1 is a perspective view of a standard miniature circuit breaker and a prior art lockout before assembly on the circuit breaker as has been described above in the background of the invention.
Figure 2:
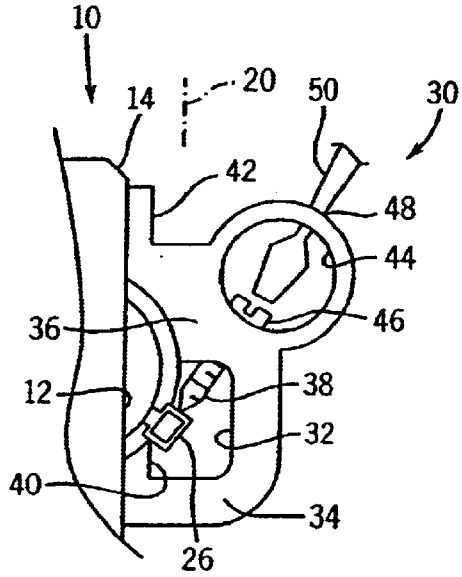
FIG. 2 PRIOR ART
FIG. 2 is a side elevational view of the prior art lockout when assembled to the miniature circuit breaker of FIG. 1.
Figure 3:
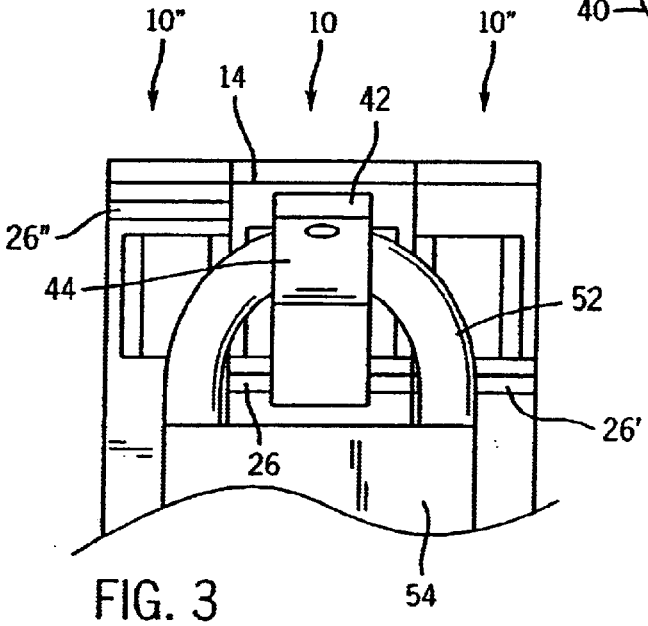
FIG. 3 PRIOR ART
FIG. 3 is a front elevational view of the lockout assembled to a circuit breaker in a bank of circuit breakers showing placement of the shackle of a padlock through the eye of the lockout where the padlock blocks the adjacent circuit breakers.
Figure 4:
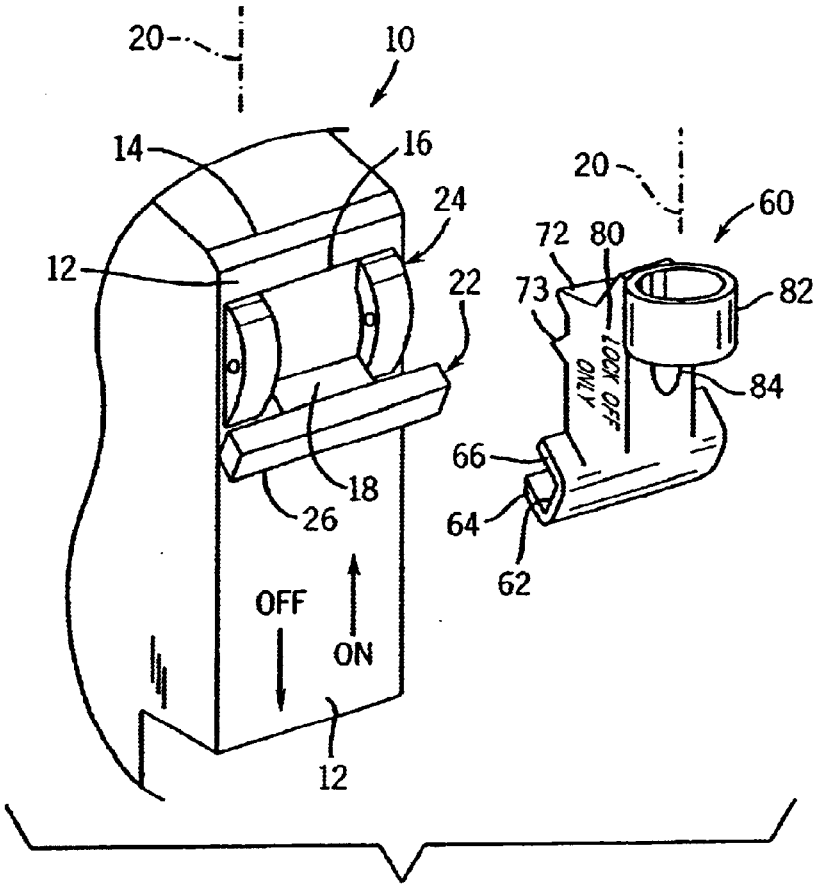
FIG. 4 is a figure similar to that of FIG. 1 showing a lockout of the present invention having a longitudinal eye.
Figure 5:
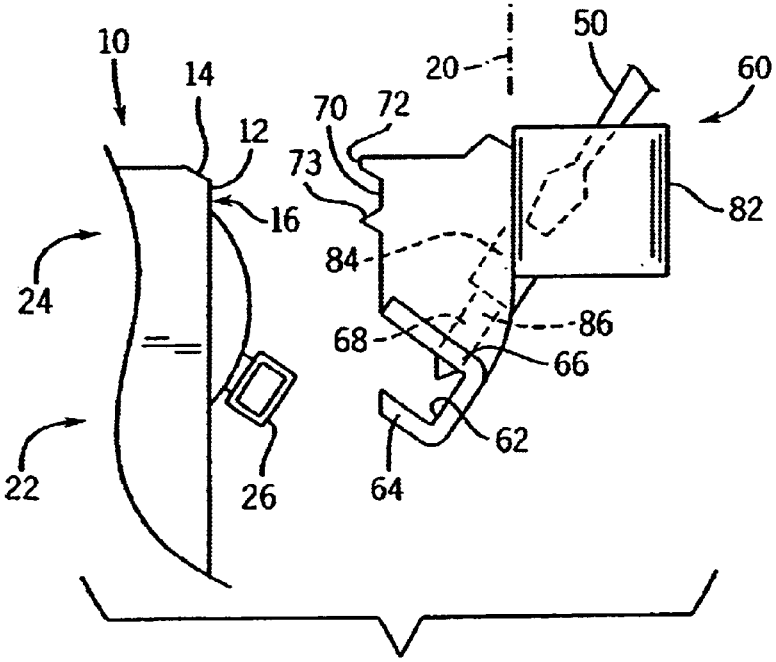
FIG. 5 is a side elevational view of FIG. 4 showing placement of a set screw for engaging the toggle of the circuit breaker and an access path for a screw driver to that set screw.

Referring to FIGS. 4 and 5, a lockout 60 of the present invention provides a transversely extending channel 62 having an opposed first wall 66 and second wall 64 such as may receive the toggle bar 26 along its entire length. A set screw 68 passes through the first wall 66 and into the channel 62 where it may compress the toggle bar 26 between the end of the set screw 68 and the inner surface of the second wall 64 capturing the toggle bar 26 within the channel 62.

The channel 62 is sized to minimize the gap between the channel 62 and the toggle bar 26, when the toggle bar 26 is in the channel 62, preventing tampering with the set screw 68. The length of the channel 62 may be substantially equal to the transverse length of the toggle bar 26 so that the channel 62 stabilizes and supports the toggle bar 26 along its entire length.

Extending from the first wall 66 is a foot 70 sized to rest in part on the front surface of the escutcheon plate 12 of the circuit breaker 10 above the toggle bar 26. The foot includes a heel 73 fitting within an opening 16 in the escutcheon plate 12 through which the toggle operator 18 extends. The heel 73 prevents upward motion of the lockout 60 along axis 20 when the lockout 60 is engaged with the toggle bar 26.

The foot may also include a toe 72 fitting over the edge 14 of the escutcheon plate 12 to help locate the lockout 60 and to prevent its use in inverted fashion to hold the toggle in the ON position. The proper use of the lockout 60 is further emphasized by lettering 80 molded on the side of the lockout 60 between the foot 70 and the first wall 66 which reads: "LOCK OFF ONLY".

An eye 82 is attached to the body of the lockout 60 and positioned over a counter bore 84 leading to the head 86 of the set screw 68. The length of the set screw 68 and the size of the counter bore 84 is adjusted so that when the set screw 68 is rotated to clamp the toggle bar 26, the head 86 of the set screw 68 is nested within the counter bore 84 and does not to interfere with a shackle of a padlock passing through the eye 82. Nevertheless, when a shackle is placed within the eye 82, the portion of the shackle within the eye 82 covers the counter bore 84 and access to the head 86 of the set screw 68 is prevented.

When the eye 82 is free of the shackle, a screwdriver blade 50 may be inserted angularly through the longitudinally extending aperture of the eye 82 to fit within the counter bore 84 for turning the set screw 68 into engagement or release from the toggle bar 26. A wall of the eye 82 opposite the counter bore 84 may be notched to improve access by the screwdriver blade 50.

Figure 6:
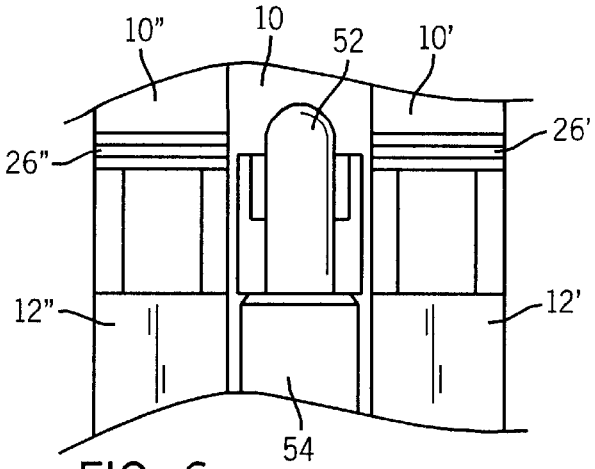
FIG. 6 is a figure similar to that of FIG. 3 showing orientation of a padlock using the present invention such as minimizes interference with adjacent circuit breakers.

Referring now to FIG. 6, the shackle 52 of a padlock may extend vertically through the eye 82 so that the case 54 of the padlock may be turned so as not to interfere with adjacent circuit breakers 10' or 10". In this manner, lockouts may be simultaneously used for each of the adjacent circuit breakers 10' through 10" and the padlock does not interfere with the operation of the adjacent circuit breakers 10' through 10". The eye 82 may be positioned on the lockout 60 so that when it is installed on the circuit breaker 10, the shackle 52 of the padlock is substantially vertical and thus does not have a tendency to twist.

Figure 7:
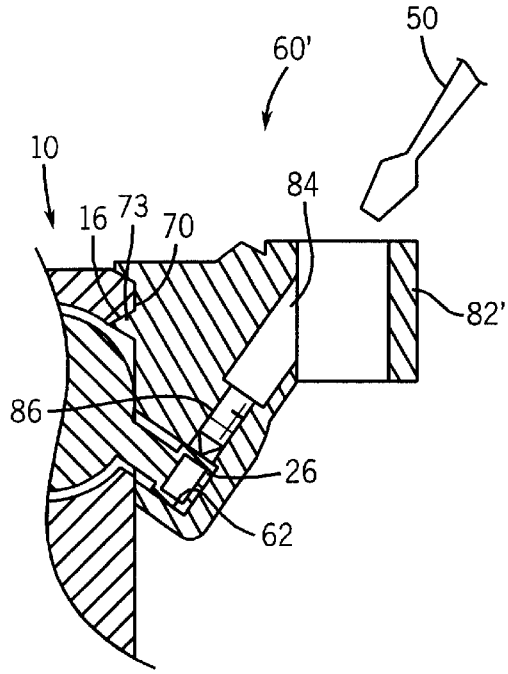
FIG. 7 is a side elevational cross section of an alternative embodiment of the invention assembled to a circuit breaker showing a heel portion of the lockout that engages an access hole in the escutcheon plate of the circuit breaker.

Referring now to FIG. 7, the shape of the channel 62 and of the foot 70 and heel 73 of lockout 60' may be modified to conform to circuit breakers 10 of different styles following the above described general principles. In this example, the heel 73 is increased in size and the toe eliminated. The height of the eye 82' is lowered while still allowing the shank of the padlock passing through the eye 82' to cover the counter bore 84 in which the set screw 68 is placed.

Figure 8:
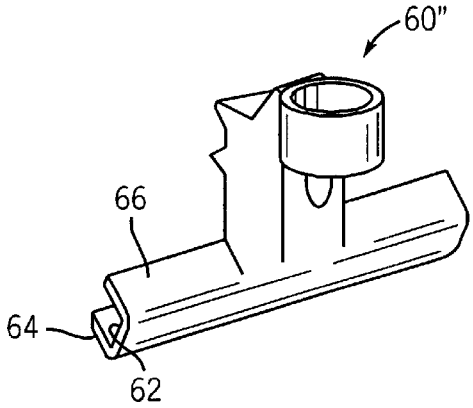
FIG. 8 is an alternative embodiment of the lockout of FIG. 4 in perspective such as provides simultaneous lockout of multiple, adjacent circuit breakers.

Referring to FIGS. 6 and 8, the lockout of FIG. 4 may be modified to produce a lockout 60" having a transversely wider channel 62 extending a multiple (2 or more) times the width of the toggle bar 26 so that the first and second walls 66 and 64 may cover and therefore lock more than one toggle bar 26 on adjacent circuit breakers 10 through 10".

It is specifically intended that the present invention not be limited to the embodiments and illustrations contained herein, but include modified forms of those embodiments including portions of the embodiments and combinations of elements of different embodiments as come within the scope of the following claims.

We claim:

1. A lock-out for a circuit breaker, the circuit breaker having a toggle operator switchable between an on and an off position, the lock-out comprising:

a channel defined by opposed first and second walls extending generally along a transverse direction for receiving the toggle operator therebetween and preventing the switch from being opened and closed, the first wall including a hole extending therethrough;

a screw fitting within the hole and extendable toward the second wall by rotation of the screw, the extension serving to clamp the toggle operator within the channel;

a foot attached to the channel to engage a portion of the circuit breaker other than the toggle operator to resist switching of the toggle operator when the toggle operator is clamped in the channel; and a longitudinally extending eye connected to the first wall and defining an opening configured to receive a shackle of a padlock along a direction substantially perpendicular to the transverse direction so that the shackle blocks access to a head of the screw.

2. The lock-out of claim 1 wherein the screw is a set screw having its head positioned within the hole and wherein the received shackle covers the hole.

3. The lock-out of claim 1 wherein the hole opens into the longitudinal eye.

4. The lock-out of claim 1 wherein the toggle of the circuit breaker extends from a opening in an escutcheon plate and wherein the foot includes a heel portion fitting within the opening.

5. The lock-out of claim 1 wherein the toggle of the circuit breaker extends through an escutcheon plate and wherein the foot includes a toe portion fitting over an outer edge of the escutcheon plate.

6. The lock-out of claim 1 wherein the eye is oriented so that the shackle of the padlock is substantially vertical when the circuit breaker is mounted so that the toggle operator switches in a vertical direction.

7. The lock-out of claim 1 wherein the lock-out is a zinc casting.

8. The lock-out of claim 1, further comprising written instructions for use formed in its surface.

9. The lock-out of claim 1 wherein the channel fully covers the toggle operator when the toggle operator is positioned within the channel.

10. The lock-out of claim 1 wherein the channel extends at least two times the length of the toggle operator to engage toggle operators of adjacent circuit breakers.

11. The lock-out of claim 1 wherein the toggle of the circuit breaker extends from an escutcheon plate, and wherein the lock-out further comprises a protrusion extending from the foot and engaging the escutcheon plate.

12. A lock-out for a manual electrical disconnect device having a toggle operator switchable between an on and an off position, the lock-out comprising:

a channel extending generally along a transverse direction having opposed first and second walls for receiving the toggle operator therebetween, the first wall including a hole extending therethrough;

a screw fitting within the hole and extendable toward the second wall by rotation of the screw, the extension serving to clamp the toggle operator within the channel;

a foot attached to the channel to engage a portion of the disconnect device other than the toggle operator to resist switching of the toggle operator when the toggle operator is clamped in the channel, wherein an extension protrudes from the foot and engages a surface of the disconnect device to prevent slippage of the lock-out relative to the disconnect device; and an eye connected to the channel to receive a shackle of a padlock so that the shackle blocks access to a head of the screw.

13. The lock-out of claim 12 wherein the screw is a set screw having its head positioned within the hole and wherein the received shackle covers the hole.

14. The lock-out of claim 12 wherein the toggle of the disconnect device extends from a opening in an escutcheon plate and wherein the protrusion includes a heel portion fitting within the opening.

15. The lock-out of claim 12 wherein the toggle of the disconnect device extends through an escutcheon plate and wherein the protrusion includes a toe portion fitting over an outer edge of the escutcheon plate.

16. The lock-out of claim 12 wherein the eye is oriented so that the shackle of the padlock is substantially vertical when the disconnect device is mounted so that the toggle operator switches in a vertical direction.

17. The lock-out of claim 12 wherein the shackle extends substantially perpendicular to the transverse direction.

18. The lock-out of claim 12, further comprising written instructions for use formed in its surface.

19. The lock-out of claim 12 wherein the channel fully covers the toggle operator when the toggle operator is positioned within the channel.

20. The lock-out of claim 12 wherein the channel extends at least two times the length of the toggle operator to engage toggle operators of adjacent disconnect devices.

* * * * *